United States Patent [19]

Moeller

[11] Patent Number: 4,956,620

[45] Date of Patent: Sep. 11, 1990

[54] WAVEGUIDE MODE CONVERTER AND METHOD USING SAME

[75] Inventor: Charles P. Moeller, Del Mar, Calif.

[73] Assignee: The United States of America as represented by the United States Department of Energy, Washington, D.C.

[21] Appl. No.: 381,756

[22] Filed: Jul. 17, 1989

[51] Int. Cl.[5] ..... H01P 1/16; H01P 3/00; H01P 3/14

[52] U.S. Cl. ..... 333/21 R; 333/241; 333/242

[58] Field of Search ..... 333/21 R, 242, 241; 350/96.10, 96.15, 96.29, 96.30, 320

[56] References Cited

U.S. PATENT DOCUMENTS

| | | | |
|---|---|---|---|
| 4,144,510 | 3/1979 | Brown et al. | 333/241 |
| 4,246,584 | 1/1981 | Noerpel | 333/242 X |
| 4,429,290 | 1/1984 | Devan | 333/241 |
| 4,482,899 | 11/1984 | Dragone | 333/21 R |
| 4,680,558 | 7/1987 | Ghosh et al. | 333/21 R |

OTHER PUBLICATIONS

Moeller, "Mode Converters Used in the Doublet III ECH Microwave System," *Int. J. Electronics*, vol. 53, No. 6, pp. 587–593 (1982).

Dragone, "Reflection, Transmission, and Mode Conversion in a Corrugated Feed," *The Bell System Technical Journal*, vol. 56, No. 6, pp. 835–867 (Jul.–Aug. 1977).

Buckley et al., "New Compact Quasi-Periodic and Aperiodic Mode Converters for 60 and 140 GHz Gyrotrons," Twelfth Int'l Conf. on Infrared and Millimeter Waves, Dec. 14–18, 1987, Lake Buena Vista, Fla.

Two pages from the *Electronics Designer's Handbook*, Second Edition, pp. 8–36, 8–37 (McGraw Hill 1977).

Doane, "Propagation and Mode Coupling in Corrugated and Smooth-Wall Circular Wavegiudes," *Infrared and Millimeter Waves*, vol. 13, chapter 5, pp. 123–170 (Academic Press 1985).

Doane, "Mode Converters for Generating the HE 11 (Gaussian-Like) Mode Form TE 01 in a Circular Waveguide," *Int. J. Electronics*, vol. 53, No. 6, pp. 573–585 (1982).

*Primary Examiner*—Brian Healy

*Attorney, Agent, or Firm*—Fitch, Even, Tabin & Flannery

[57] ABSTRACT

A waveguide mode converter converts electromagnetic power being transmitted in a $TE_{0n}$ or a $TM_{0n}$ mode, where n is an integer, to an $HE_{11}$ mode. The conversion process occurs in a single stage without requiring the power to pass through any intermediate modes. The converter comprises a length of circular corrugated waveguide formed in a multiperiod periodic curve. The period of the curve is selected to couple the desired modes and decouple undesired modes. The corrugation depth is selected to control the phase propagation constant, or wavenumbers, of the input and output modes, thereby preventing coherent coupling to competing modes. In one embodiment, both the period and amplitude of the curve may be selectively adjusted, thereby allowing the converter to be tuned to maximize the conversion efficiency.

21 Claims, 4 Drawing Sheets

34
36
P3
P2
28
P
P1
26
22
24
32
20
30
A d1
D
36
22
d
24
32 s
w
d
D
24

64
36
62
66
Z4
Z3
Z2
Z1
P3
P2
P1
22
24
60
32
Z
X

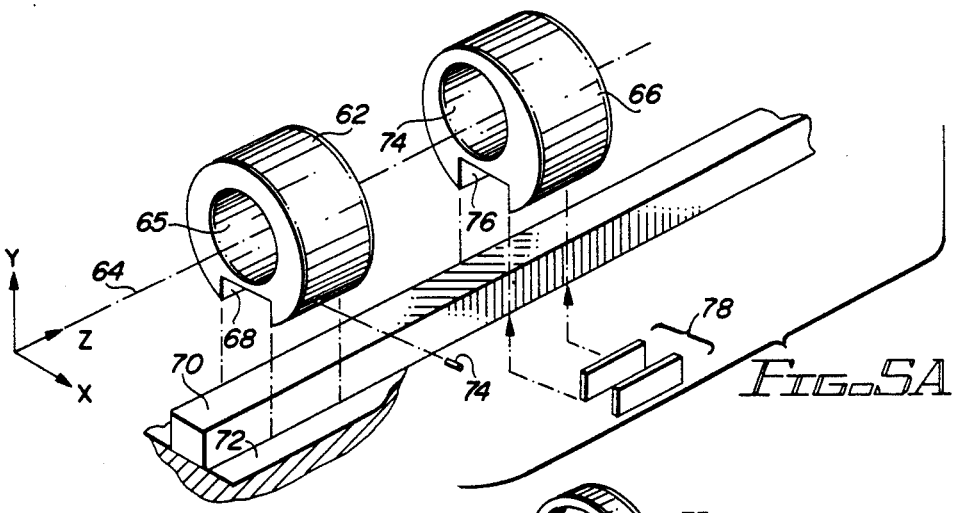
FIG. 5A
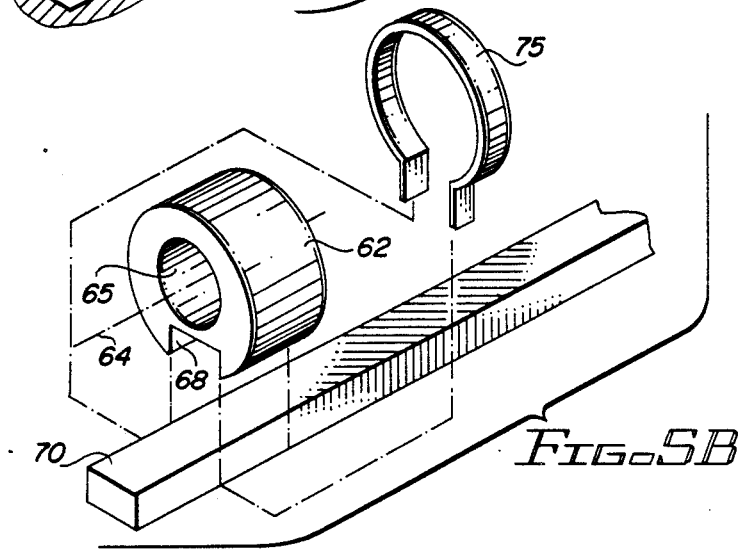
FIG. 5B
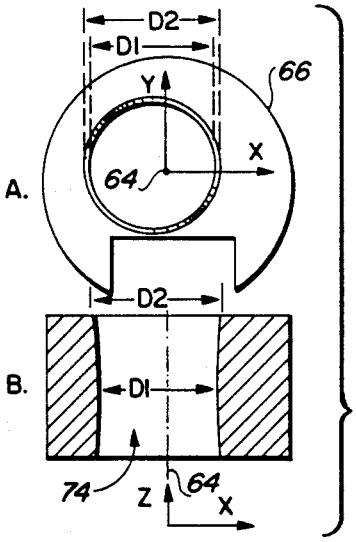
FIG. 7
FIG. 6
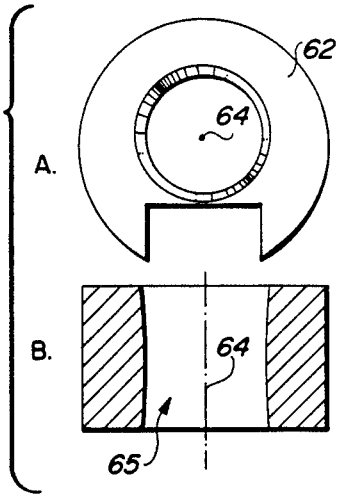

WAVEGUIDE MODE CONVERTER AND METHOD USING SAME

This invention was made with Government support under Contract DE-AC03-84ER51044 awarded by the Department of Energy. The Government has certain rights in this invention.

BACKGROUND OF THE INVENTION

The present invention relates to waveguide mode converters, and more particularly to a mode converter that converts directly from a circular waveguide mode having no angular dependence to the $HE_{11}$ mode.

Waveguides are a form of transmission line used to transmit electromagnetic energy efficiently from one point to another. Waveguide modes are denominated to identify the distribution of the electric and magnetic fields within the waveguide. As indicated in the *Electronics Designers' Handbook*, 24 Edition (McGraw-Hill 1977) at page 8–36, specific modes are indicated by symbols such as $TE_{mn}$ and $TM_{mn}$. TM indicates that the magnetic field is everywhere transverse to the axis of the transmission line, i.e., the longitudinal axis of the waveguide. TE indicates that the electric field is everywhere transverse to the axis of the waveguide. The subscripts m and n denote the number of full or half period variations of the fields occurring within the waveguide, as explained more fully below.

In addition to the TE and TM modes, an $HE_{mn}$ mode also exists for circular corrugated waveguides. This mode is described in the literature. See, e.g., Doane, "Propagation and Mode Coupling in Corrugated and SmoothWall Circular Waveguides," *Infrared and Millimeter Waves*, Vol. 13, Chapter 5, pp. 123–170 (Academic Press, 1985). The HE mode is somewhat similar to the TE mode, except that a different radiation pattern of the electromagnetic energy is obtained when the waveguide terminates. As explained hereinafter, such a radiation pattern offers distinct advantages over other patterns obtained from other modes.

For circular waveguides, the subscript m used with the waveguide symbol denotes the number of full-period variations of the transverse component of field in the angular direction. The subscript n denotes the number of half-period variations of the transverse component of field in the radial direction. A waveguide mode having no angular dependence may thus be either a $TE_{0n}$ or a $TM_{0n}$ mode, where n is any integer. The present invention is thus concerned with a waveguide mode converter that converts directly from a $TE_{0n}$ or a $TM_{0n}$ mode to the $HE_{11}$ mode.

Waveguides with transverse dimensions large compared to wavelength become necessary at millimeter wavelengths in order to reduce loss and to prevent breakdown in high power applications. Such waveguides are called "overmoded" since more than one waveguide mode can propagate. See, Doane, supra A significant problem facing waveguide mode converters of overmoded waveguides is to confine the available energy to the desired modes, and to prevent energy from being coupled to undesired modes. This requirement is frequently referred to as minimizing mode competition or reducing cross-coupling.

The $HE_{11}$ mode advantageously radiates a symmetric pencil beam having low side lobes and low cross polarization. This type of radiation has application to, e.g., antenna structures, laser devices, fiber optics, and rocket launching systems. Unfortunately, most sources of microwave energy provide an output mode of transmission other than the $HE_{11}$ mode of transmission, such as the $TE_{01}$ mode of transmission. Hence, there is a need to convert the transmission mode of the energy source to the $HE_{11}$ mode before the advantages of the $HE_{11}$ mode can be fully exploited.

Moreover, for high energy applications, such as rocket launching systems (where the high energy microwave signals are used for plasma heating), or sophisticated high power radar systems, the source of the high energy signal is typically a gyrotron, or equivalent device, which cannot always be positioned near the location in the apparatus or system where the $HE_{11}$ mode of transmission is required. While the $HE_{11}$ mode can be transmitted efficiently (without significant loss) through a corrugated waveguide, the cost of corrugated waveguide per unit length is much higher than the cost of smooth-wall waveguide per unit length. Hence, where the transmission distance is more than just a few meters, the less-costly smooth-wall waveguide becomes the preferred mode of transmission. There is thus a need to: (1) transfer the energy from the source to its destination using a cost-effective smooth-wall waveguide operating in an appropriate mode, such as the $TE_{01}$ mode of transmission, and (2) convert the mode of transmission to the $HE_{11}$ mode once the energy has been delivered to its desired destination within the system.

There are no conversion methods known at present that convert directly from the optimum transmission mode, e.g., the $TE_{01}$ or $TM_{01}$ mode, to the desired $HE_{11}$ mode. Rather, known conversion systems utilize a two stage method to achieve the desired conversion. See, e.g., Doane, "Mode converters for generating the HE 11 (gaussian-like) mode from TE 01 in a circular waveguide," *Int. J. Electronics*, Vol. 53, No. 6, pp. 573–585 (1982). That is, a first conversion is made from the optimum $TE_{01}$ transmission mode to an intermediate mode; and a second conversion is then made from the intermediate mode to the desired $HE_{11}$ mode. The intermediate mode is typically either the $TE_{11}$ mode or the $TM_{11}$ mode.

In the case where the intermediate mode is the $TE_{11}$ mode, a $TE_{01}$ to $TE_{11}$ converter is used as a first stage. One common embodiment of such a $TE_{01}$ to $TE_{11}$ converter comprises a specially machined waveguide having periodic radial perturbations. See, Moeller, "Mode converters used in the Doublet III ECH microwave system," *Int. J. Electronics*, Vol. 53, No. 6, pp. 587–593 (1982). Unfortunately, such a converter has a narrow bandwidth, requires high machining tolerances and must include many periods in its overall length. Another embodiment utilizes periodic perturbations of special shape in order to avoid competition with the $TE_{12}$ mode.

Disadvantageously, in both embodiments the ohmic losses of the $TE_{11}$ mode limit the permissible length of the converter. Moreover, the second stage, the $TE_{11}$ to $HE_{11}$ converter, also has a limited bandwidth because it contains an abrupt transition from smooth wall waveguide to corrugated wall waveguide, having one-half wavelength deep corrugations. This abrupt transition necessarily causes a narrow band width.

In the case where the intermediate mode is the $TM_{11}$ mode, a first stage of the desired converter comprises a $TE_{01}$ to $TM_{11}$ converter that includes a smooth-wall circular waveguide that curves or bends a prescribed amount within a plane while accurately maintaining the circularity of the waveguide's bore. Such a first stage requires tight machining tolerances, and is thus expensive and difficult to make. Moreover, the $TM_{11}$ mode inherently has substantial ohmic loss associated with its operation, as well as high electric fields present at the waveguide wall. The substantial ohmic loss disadvantageously affects the overall efficiency of the converter, and the high electric field at the waveguide wall makes the waveguide susceptible to breakdown. While a second stage of the desired converter, comprising a $TM_{11}$ to $HE_{11}$ converter, has a wider bandwidth and a less critical transition from smooth to corrugated waveguide than does its $TE_{01}$ to $TM_{11}$ counterpart, the inefficiencies of the first stage prevent an efficient overall conversion.

It is thus apparent that a more efficient $TE_{01}$ or $TM_{01}$ to $HE_{11}$ converter is needed, preferably one that contains only low loss modes, has a wide bandwidth, does not suffer from mode competition, and is easily and inexpensively fabricated. The present invention advantageously addresses these and other needs.

SUMMARY OF THE INVENTION

The present invention provides a $TE_{01}$ or $TM_{01}$ to $HE_{11}$ converter that carries out the desired mode conversion directly and efficiently in a single stage, without requiring conversion to any intermediate modes, such as the $TE_{11}$ or $TM_{11}$ modes, through the use of additional stages, as are required in known prior art converters. This conversion is accomplished in a length of substantially circular corrugated waveguide formed in a multiperiod periodic planar curve. The period of the planar curve is selected to assure that the desired modes are coupled and non-desired modes are not coupled. The corrugation depth is selected to further control the phase propagation constant, or wavenumbers, of the input and output modes, thereby preventing coherent coupling to competing modes. In one embodiment, both the period and amplitude of the planar curves formed in the waveguide may be selectively adjusted, thereby allowing the converter to be tuned to maximize the conversion efficiency and to compensate for manufacturing tolerances.

In its simplest form, apparatus of the present invention is used to convert a first mode of transmission of electromagnetic power at a given free space wavelength to a second mode of transmission at the same wavelength. The apparatus includes a length of circular corrugated waveguide of predetermined inner diameter and annular corrugations formed into a multiperiod periodic planar curve. The period of the curve is substantially equal to $2\pi$ divided by the difference in axial wavenumbers of the respective first and second modes of transmission in the waveguide.

One embodiment of the present invention may further be described as a tunable waveguide mode converter. Such a converter includes at least: (1) a length of circular corrugated waveguide formed into a multiperiod periodic planar curve, the periods of the multiperiod curve having a period P measured along the longitudinal axis of the waveguide and the periodic planar curve having an amplitude A measured transverse to the longitudinal axis; (2) first adjustment means for selectively adjusting the period P; and (3) means for coupling electromagnetic power being transmitted in a first transmission mode, such as the $TE_{01}$ or the $T_{01}$ modes, to a first end of the length of circular waveguide. Additional embodiments further include second adjustment means for adjusting the amplitude A. In such a converter, the period P is adjusted with the first adjustment means to directly couple power of the first transmission mode to a second transmission mode, such as the $HE_{11}$ mode, and to decouple power of the first transmission mode to modes other than the second transmission mode. Such coupling and decoupling is achieved, in accordance with known principles of electromagnetic wave propagation theory, by choosing P so that the power converted at the curves adds in phase for the desired mode but adds out of phase (subtracts) for other modes.

The corrugated waveguide used with the apparatus or method of the present invention is substantially circular. Advantageously, the annular corrugations keep the waveguide circular in spite of buckling forces that are created in forming the multiperiod periodic planar curve. Further, while smooth-wall -waveguides must be made curved by machining (a time consuming, expensive operation), the corrugated waveguide of the present invention is made curved simply by bending. The slight differences in spacing of different parts of corrugations upon bending can be ignored. The curve need not be sinusoidal and need not be complete periods or begin at a maximum bend.

For optimum conversion efficiency, it is necessary that the period of the planar curve be $2\pi/\Delta$ where $\Delta\beta$ is the difference between the axial wavenumbers of the respective first and second modes transmission, and not half or twice this length. Further, in order to maintain linear polarization, it is also necessary that the curve be planar; that is, the curve cannot lie in different planes for different periods, nor can it be helical. Hence, the length of waveguide is preferably considered as a single multiperiod periodic curve, rather than a concatenation of separate curves. Moreover, it is noted that the period P is measured along the longitudinal axis, not along the curve. That is, the period P does not change with amplitude A. Further, while conversion depends upon curvature, as explained below, it is generally preferable not to convert too much power from one mode to another in a single peak or there is difficulty in canceling out the unwanted conversions. The number of periods is preferably determined empirically. The inner diameter of the waveguide determines the spacing of modes. A larger diameter makes the modes more closely spaced, requiring more periods. For a given number of periods, there is a maximum displacement or amplitude for optimum conversion. The more periods, the less the maximum amplitude.

Advantageously, the corrugations of the waveguide provide a variable that can be controlled to improve the coupling efficiency. A corrugation depth of $\lambda/4$ should be avoided in order to prevent a degenerative condition wherein power is converted to unwanted modes. However, by selecting a corrugation depth more than $\lambda/8$ from $\lambda/4$, the degenerative condition can be avoided and power can be coupled efficiently to the desired $HE_{11}$ mode and not to other modes.

The present invention further includes a method for converting electromagnetic power at a given free space wavelength from a $TE_{0n}$ or $TM_{0n}$ input mode, where n is an integer, to an $HE_{11}$ output mode. This method comprises applying the power in the input mode to the input end of a length of circular corrugated waveguide of given inner diameter and annular corrugations formed in a multiperiod periodic planar curve, adjusting the period of the curve to maximize power radiating from the output end of the length of waveguide in the $HE_{11}$ output mode, and adjusting the amplitude of the curve to minimize the power radiating from the output end of the length of waveguide in the input mode.

It is an aspect of the present invention to provide a mode converter for millimeter-wave signals having a wide bandwidth.

It is another aspect of the invention, in accordance with one embodiment thereof, to provide such a mode converter using only low loss modes, such as the $TE_{01}$ mode, advantageously avoiding high loss modes, such as $TE_{11}$ or $TM_{11}$ modes.

It is a further aspect of the invention to provide a mode converter wherein ohmic losses remain low.

It is still a further aspect of the invention to provide such a mode converter wherein the conversion is direct without any intermediate modes.

It is yet another aspect of the invention to provide a mode converter and method of mode conversion wherein the input mode is converted directly to the desired output mode without any significant competition from competing modes.

It is still another aspect of the invention to provide a direct mode converter and method of mode conversion using corrugated waveguide that minimizes competing modes by selecting a corrugation depth that controls the difference between the phase propagation constants (axial wavenumbers) of the coupled modes.

It is another aspect of the invention to provide such a direct mode converter and method of mode conversion that maximizes coupling between desired modes. Such coupling is achieved by forming a multiperiod periodic curve in the waveguide of a selected amplitude and period, selected such that power converted at the curves adds in phase for the desired modes but adds out of phase (subtracts) for other modes.

It is another aspect of the invention to provide a mode converter that is easily fabricated without strict mechanical tolerances.

It is a further aspect of the invention to provide a mode converter that is tunable, advantageously allowing the conversion efficiency to be maximized by compensating for manufacturing tolerances.

BRIEF DESCRIPTION OF THE DRAWINGS

The above and other advantages, aspects and features of the present invention will be more apparent from the following more particular description thereof, particularly when considered in conjunction with the accompanying drawings, wherein:

FIG. 5A is an exploded isometric view of the centering and offset rings of FIG. 4;

FIG. 5B is an exploded isometric view of the centering ring as in FIG. 5A, showing an alternative method for holding the ring in a desired position;

FIGS. 6A and 6B are end and sectional views, respective, of the centering ring of FIG. 4;

FIGS. 7A and 7B are end and sectional views, respective, of the offset ring of FIG. 4;

DETAILED DESCRIPTION OF THE INVENTION

The following description is of the best mode presently contemplated for practicing the invention. This description is not to be taken in a limiting sense but is made merely for the purpose of describing the general principles of the invention.

Figures 1A, 1B, 1C, 4:
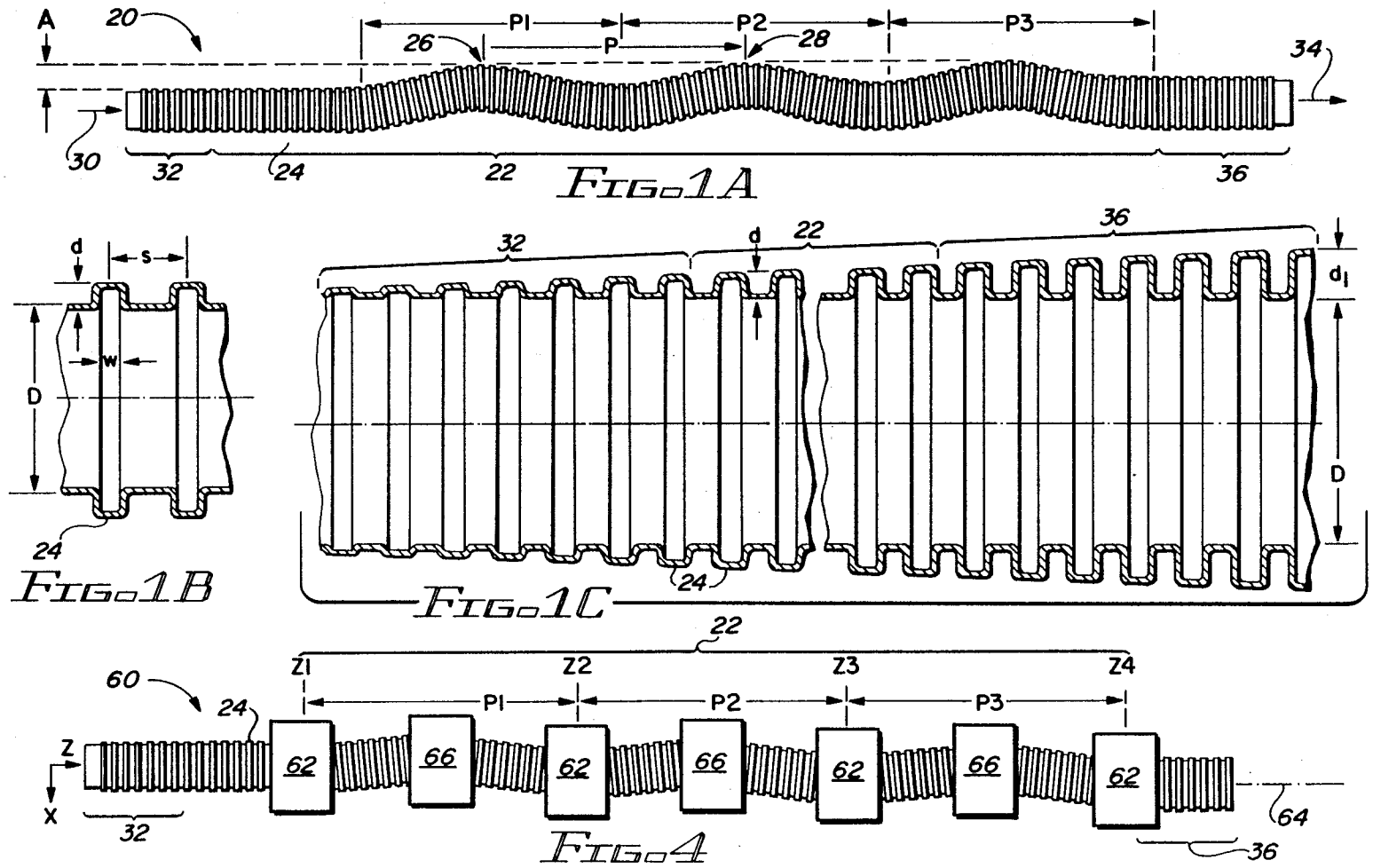
FIG. 1A is a plan view of a mode converter made from corrugated waveguide in accordance with the present invention.
FIG. 1B is an enlarged vertical view of a section of corrugated waveguide and illustrates the various parameters used in defining such waveguide.
FIG. 1C is a vertical sectional view of the input and output end portions of the mode converter of FIG. IA and further illustrates a preferred technique for tapering the corrugation depth of the mode converter at these end portions.
FIG. 4 illustrates a tunable three-period corrugated waveguide mode converter utilizing centering and offset rings.

FIG. 1A is a plan view of a waveguide mode converter 20 made in accordance with the present invention. The converter includes a length of circular waveguide 22 having spaced-apart annular corrugations 24 therein. The waveguide 22 is curved to form a plurality of cycles of a substantially sinusoidal curve having a wavelength or period P. To avoid confusion with the wavelength of the electromagnetic waves, this wavelength of the curves formed in the converter will be referred to herein as the period of the mode converter. The period P is illustrated in FIG. IA as extending from a first peak 26 of the sinusoidal curve to a second peak 28 of the sinusoidal curve. As with any periodic curve, this period P could be measured between any recurring reference points. Further, while a sinusoidal curve is shown, any other curve having a radius R could be used. (A selected segment of the sinusoidal curve may generally be modeled as a segment of a circle having a radius R using known mathematical techniques). The peaks 26 and 28 are selected for defining the period P only for convenience. As further shown in FIG. 1A, the curve has an amplitude of deflection A as measured, for example, peak to peak. As will be explained more fully below, the number of periods formed in the circular waveguide 22 may vary. At least two complete cycles are required for most applications. Typically, three or more cycles having a period P will be utilized. For example, in the embodiment of the waveguide mode converter 20 shown in FIG. 1A, three cycles of equal periods are employed: a first period P1 measured from the first low to the second low, a second period P2 measured from the second low to the third low, and a third period P3 measured from the third low to the last low.

In operation, electromagnetic power 30 from a suitable source (not shown in FIG. 1A) is transmitted in accordance with a first transmission mode having no angular dependence, such as a $TE_{01}$ or a $TM_{01}$ mode. This power 30 has a free space wavelength $\lambda$. For most applications of the mode converter herein disclosed, this wavelength $\lambda$ is in the millimeter range. The power 30 is applied to an input section 32 of the converter 20.

As this power travels through the corrugated waveguide 22, it is efficiently converted to electromagnetic power 34 in the $HE_{11}$ mode. The converted power is represented as the arrow 34 at an output section 36 of the converter. The manner in which this conversion occurs is explained more fully below.

To better understand the conversion process, and in particular the parameters that affect it, reference is made to FIG. 1B, wherein a sectional view of a portion of circular corrugated waveguide 22 is illustrated. The main bore of the waveguide is circular having an inner diameter D. Annular corrugations 24, having an internal width w, an internal depth d, and centers spaced apart a distance s, are spaced along the central axis of the waveguide. Although FIG. 1B shows the corrugation separation distance s to be approximately twice the corrugation width w, and shows the corrugation depth d as being approximately the same as the width w, the illustration is only to clearly show how a given parameter is defined, and is not meant to convey actual proportions that may be used. For example, a typical corrugated waveguide designed for use with 60 Ghz power ($\lambda=5$ mm) may have a diameter of 1.094 inches (2.78 cm), a corrugation depth d of 0.6 mm, and a corrugation spacing s of 1–2 mm. Moreover, these distances are typically specified in terms of a percentage of the wavelength $\lambda$. That is, the corrugation depth d may be, for example, $\frac{1}{4}\lambda$. Preferably, the corrugation spacing s is less than $\frac{1}{2}\lambda$.

Referring next to FIG. 1C, a partial vertical sectional view of the mode converter 20 of FIG. 1A is depicted for use when converting the $TE_{01}$ mode to the $HE_{11}$ mode. This view is presented to highlight the preferred manner in which the corrugation depth should be tapered at the input section 32 and the output section 36 of the mode converter 20. (The relative dimensions shown in FIG. 1C for the corrugation depth d are greatly exaggerated relative to the diameter D in order to emphasize the tapering that is used.) As seen in FIG. 1C, at the beginning of the input section 32, the waveguide starts out without any corrugations. This allows the input section 32 to interface directly with a smooth wall waveguide from the power source without significantly narrowing the bandwidth. As the axial distance into the mode converter increases, however, corrugations of increasing depth appear until at the end of the input section 32 the corrugations have a depth d. The corrugations maintain the depth d throughout the main section 22 of the converter. The main section 22 is the section wherein the periodic curve occurs (which curve is not shown in FIG. 1C). At the beginning of the output section 36, the depth of the corrugations again begins to change until at the end of the output section 36 the corrugation depth is $d_1$, typically a depth greater than d. A mode converter designed for operation at 60 GHz ($\lambda=5$ mm), for example, may have a waveguide diameter of 1.094 inches (2.78 cm) and a corrugation depth of $\frac{1}{4}\lambda$ (1.25 mm) in the main section 22 of the converter, and a corrugation depth d, of $\frac{1}{4}\lambda$ (1.25 mm) at the end of the end section 36. At 60 GHz, the length of the input section 32 in which the corrugation depth tapers from 0 to $\frac{1}{8}\lambda$ may be on the order of 10 cm. Similarly, at this frequency, the length of the output section 36 in which the corrugation depth tapers from $\frac{1}{8}\lambda$ to $\frac{1}{4}\lambda$ may be on the order of 20 cm; although as suggested in FIG. IC, the output section 36 may be of approximately the same length as the input section 32.

Figure 2:
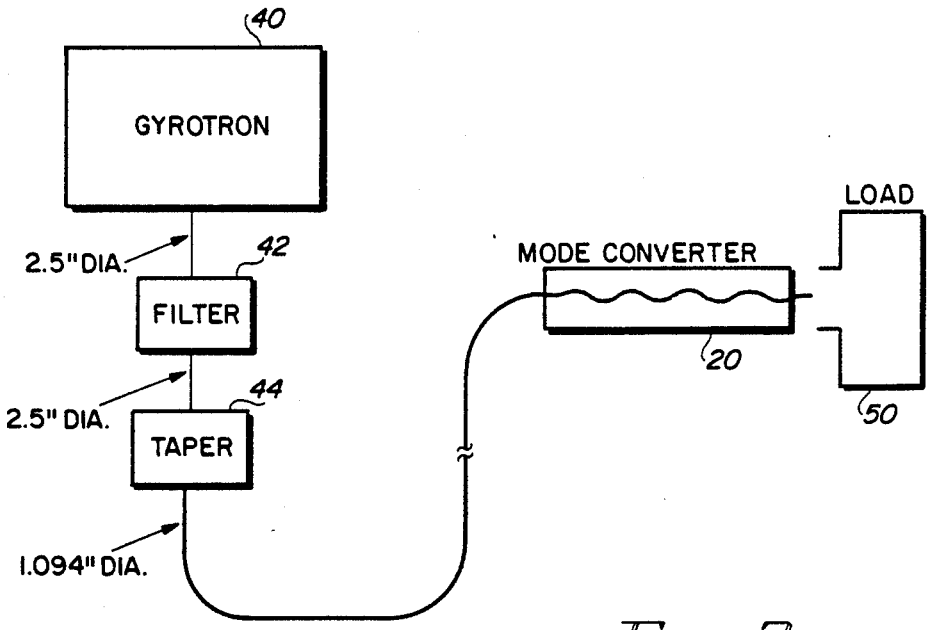
FIG. 2 is a block diagram of a microwave transmission system utilizing the mode converter of the present invention.

Referring next to FIG. 2, a representative block diagram of a microwave transmission system utilizing the mode converter of the present invention is illustrated. The function of any such system is to transmit power efficiently, typically power in the millimeter wavelength region, from a source 40, such as a conventional gyrotron, to a load 50. Applications of the present invention require that the power be presented to the load 50 in the $HE_{11}$ mode. Unfortunately, most gyrotrons or other sources of millimeter wavelength power do not provide power in the $HE_{11}$ mode. Hence, the mode converter 20 is inserted somewhere intermediate the source 40 and the load 50. Conventional waveguide devices, such as a filter 42 and a taper 44, may also be included in the transmission network. The filter 42 may be used, for example, to dampen unwanted modes coming from the system. The taper 44 may be used to convert the size of the transmission waveguide available at the output of the gyrotron 40 to a convenient size for coupling to the load 50. Other common waveguide devices, such as directional couplers, d.c. breaks, and the like, could also be utilized in the transmission network as required for the particular application involved. A common diameter for circular waveguides provided at the output port of a 60 GHz gyrotron, for example, is 2.5 inches. Commercially available filters, such as the filter 42, which may be a resistive wall mode filter, also have a diameter of 2.5 inches. The filter 42 is thus coupled directly to the gyrotron 40. The taper 44 is used, for example, to convert the waveguide from 2.5 inches to a smaller size, such as 1.094 inches. This is done because a smaller diameter waveguide allows waveguide bends to be of a reasonable length, occupies less space, makes the straightness of the smooth wall waveguide less critical, and is less expensive than a 2.5 inch diameter waveguide. For transmitting the power over a relatively long distance (more than a few meters), smooth wall waveguide is used, as opposed to corrugated waveguide, because it is much less expensive. For a transmission system such as is shown in FIG. 2, therefore, the mode converter 20 of the present invention is preferably placed at the end of the transmission network, i.e., near the load 50.

The conversion mechanism employed in the mode converter 20 of the present invention is in some respects similar to the conversion mechanism employed in the $TE_{01}$ to $TE_{11}$ mode smooth wall converter described by the applicant in his paper, "Mode Converters Used in the Doublet III ECH Microwave System," published in the International Journal of Electronics, Vol. 53, No. 6, at pages 587–593 (1982). As described in that publication, the use of periodic waveguide perturbations to effectuate a mode conversion was first described by Kovalev et al., "Wave Transformation in a Multimode Waveguide with Corrugated Walls," *Radio Phys. Quant. Electron.*, Vol. 11, pp. 449–450 (1969). In order to avoid the need to explicitly evaluate the integrals used in the Kovalev calculation, however, the conversion mechanism can be described in terms of the generalized telegraphist's equation approach set forth in Schelkunoff, "Conversion of Maxwell's Equations Into Generalized Telegraphist's Equations," *Bell System Technical Journal*, Vol. 34, pp. 995–1043 (1965). In accordance with this simplified approach, the generalized telegraphist's equation has the form, where reflections can be ignored, of $$\frac{dA_{m,n}}{dz} = -i\beta_{mn}A_{mn} + \sum_{m'}\sum_{n'} A_{m'n'}K_{mn}^{m'n'} \quad (1)$$

where the A's are the amplitudes of the various modes, $\beta_{mn}$ is the propagation constant (which is a function of waveguide dimensions) of the mode having amplitude $A_{mn}$, and $K_{mn}^{m'n'}$ is the coupling coefficient between the mn and m'n', mode, and the sum over m'n' excludes m,n. For a smooth wall circular waveguide the conversion between a mode involving no change in the azimuthal mode number (i.e., where the first subscript in the mode designation does not change, as from a $TE_{0n}$ to a $TE_{0(n+1)}$ mode conversion), purely radial perturbations are required, and the coupling coefficient is given (see Unger, *Bell System Technical Journal*, Vol. 37, pp 1599–1647 (1958) for a general (smooth) change in radius) as $$K_{0n}^{0n'} = \frac{1}{a}\,\frac{da}{dz}\,\frac{2k_{0n}k_{0n}}{k_{0n'}^2 - k_{0n}^2} \quad (2)$$

In equation (2), a is the local waveguide radius, z the axial position, and $k_{0n}$ the nth zero of the derivative of the $J_0$ Bessel function, $J'_0$ (excluding 0).

Where the azimuthal mode number (angular index) is changed by one, an m=1 perturbation (a curvature perturbation) is required. The coupling coefficients of a $TE_{0n}$ to $TE_{1n}$ conversion, associated with a curve of radius R, have been calculated as $$K_{01}^{1n'} = \frac{1}{R}\,\frac{g_{n'}(\beta_0 a)^2 - h_{n'}}{(\beta_{01}a\beta_{1n'}a)^{\frac{1}{2}}} + g_{n'}(\beta_{01}a\beta_{1n'}a)^{\frac{1}{2}} \quad (3a)$$

Similarly, for a $TE_{01}$ to $TM_{1n}$ conversion, the coupling coefficients have also been calculated as $$K_{01}{}^{1n'} = \delta_{1n'}\beta_0 a/(k_{01}R)^{\frac{1}{2}} \quad (3b)$$

In these equations $$\beta_0 = \omega/c \quad (3c)$$

$$g_{n'} = 2^{\frac{1}{2}}k_{01}k_{1n'}^2(k_{1n'} - 1)^{-\frac{1}{2}}(k_{01}^2 - k_{1n'}^2)^{-2} \quad (3d)$$

and $$h_{n'} = g_{n'}(k_{01} + k_{1n'})/2 \quad (3e)$$

where the k's are defined as in Equation (2).

In these conversions, each perturbation excites to a greater or lesser degree modes with all (propagating) radial mode numbers and the permissible azimuthal mode number. It is thus necessary to repeat the perturbation in such a way as to reinforce the desired mode. The number of perturbations that should be used is typically determined by the need to limit conversion to unwanted modes, rather than by limitations on the rate of conversion to the desired mode. As a general guide, if the input mode has wavenumber $\beta_{mn}$, the desired output mode wavenumber $\beta_{m'n'}$, and an unwanted mode wavenumber $\beta_{m''n''}$, then the smaller the difference between $|\beta_{mn}-\beta_{m'n'}|$ and $|\beta_{mn}-\beta_{m''n''}|$, the larger the number of perturbations that will be required (and the smaller the individual perturbation) in order to obtain a given output mode purity. It should be noted that $\beta_{m''n''}$ need not be close to $\beta_{m'n'}$ to cause difficulty.

To determine the required perturbation amplitude and period with reasonable accuracy, one need only consider the two modes of interest, with amplitudes $A_1$ and $A_2$, and wavenumbers $\beta_1$ and $\beta_2$, and with coupling coefficient $K=K_0 \cos 2\gamma z$, where $\gamma$ is a constant to be determined as indicated below. Then $$\frac{dA_1}{dz} = -i_1\beta A_1 + K_0A_2 \cos 2\gamma z = i\beta_1A_1 + K_0A_2[\exp(i2\gamma z) + \exp(-i2\gamma z)]/2 \quad (4a)$$

$$\frac{dA_2}{dz} = -i\beta_2A_2 + K_0A_1 \cos 2\gamma z = i\beta_2A_2 + K_0A_1[\exp(i2\gamma z) + \exp(-i2\gamma z)]/2 \quad (4b)$$

By defining $\overline{A}_1=\overline{A}_1 \exp(i\gamma z)$ and $\overline{A}_2=A_2 \exp(-i\gamma z)$ the equation can be rewritten $$\frac{dA_1}{dz} = -iA_1(\beta_1 - \gamma) + K_0A_2[1 + \exp(-i4\gamma z)]/2 \quad (5a)$$

$$\frac{dA_2}{dz} = -iA_2(\beta_2 - \gamma) + K_0A_1[1 + \exp(-i4\gamma z)]/2 \quad (5b)$$

By choosing $\gamma$ such that $\beta_1-\gamma=\beta_2+\gamma$ (at the average diameter in the case of the $TE_{02}-TE_{01}$ conversion), defining $\Gamma=(\beta_1+\beta_2)/2$, and dropping the rapidly oscillating terms, it is seen that $$\frac{dA_1}{dz} = -iA_1\Gamma + K_0A_2/2 \quad (6a)$$

$$\frac{dA_2}{dz} = -iA_2\Gamma + K_0A_1/2 \quad (6b)$$

which are simply a pair of coupled transmission line equations. The perturbation period $1/(2\gamma)$ is then merely the beat wavelength $\lambda_b=2\pi/(\beta_1-\beta_2)$. By forming the normal modes of the perturbed guide, $A^{\pm}=A_1 \pm iA_2$, which have wavenumbers $\beta^{35}=\Gamma\pm K_0/2$, it is apparent that there will be full transfer of power from mode 1 to mode 2 in a distance L when $$(\beta^+ - \beta^{31})L = K_0L = \pi \quad (7)$$

By a similar analysis of the normal modes when the phase velocities are not quite matched, i.e. $\gamma\neq(\beta_1-\beta_2)/2$, as might be the case if the input frequency $\omega$ differed from the design frequency $\omega_0$, the maximum amplitude mode 2 can attain is $\sin(K_0L(1+\delta^2)^{\frac{1}{2}}/2)/(1+\delta^2)^{\frac{1}{2}}$ when 1 is the amplitude at the design frequency, and $\delta=[\beta_1(\omega)-(\beta_2(\omega)-(\beta_1)(\omega_0)-\beta_2(\omega_0))]/K_0$. This result is again identical form with that for two coupled transmission lines having slightly different phase velocities.

To those skilled in the art, the above analysis shows that periodic bends placed in a smooth waveguide cause coupling between modes having angular indices differing by 1, and mode selectivity is achieved by choosing the period P of the curvatures so that the power converted at the curves adds in phase for the desired mode but out of phase for other modes. That is, if the axial wavenumbers of the input and output modes are $\beta_0$ and $\beta_1$, respectively, constructive interference requires $|\beta_0-\beta_1| = 2\pi/P$. Unfortunately, however, coupling to an undesired mode can readily occur if there is a second mode with wavenumber $\beta_2$, such that $|\beta_0-\beta_2|\approx 2\pi/P$.

The above analysis relates to smooth-wall circular waveguides. Where a corrugated waveguide is employed for the mode converter rather than a smooth-wall waveguide, an additional parameter or variable for controlling the $\Delta\beta$'s of the various modes is advantageously provided. This parameter is the corrugation depth d (see FIG. 1B). In accordance with the teachings of the present invention, control of the corrugation depth d provides a viable technique for maximizing the coupling between the desired modes and minimizing the coupling between undesired modes.

Figure 3:
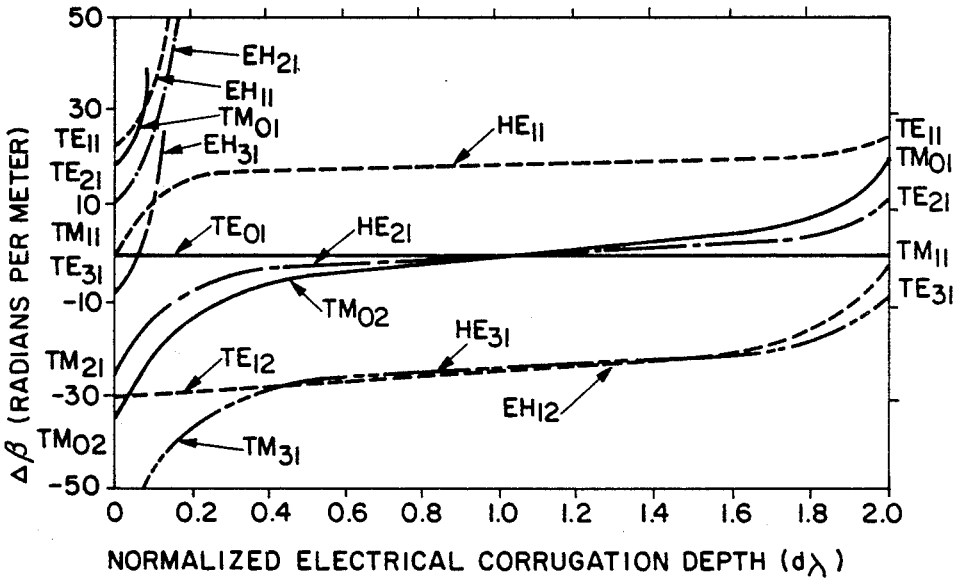
FIG. 3 is a graph illustrating changes in the phase propagation constant as a function of corrugation depth for various transmission modes.

As has been indicated, a maximum coupling occurs where $P=2\pi/\Delta\beta$. The manner in which $\Delta\beta$ varies as a function of corrugation depth has been prepared by Doane (1985), suora. and is reproduced herein as FIG. 3. In FIG. 3, the corrugation depth is defined as a normalized corrugation depth ($d_{80}$), where the left hand edge ($d_{80}=0$) corresponds to a smooth wall, the center ($d_{80}=1.0$) corresponds to a corrugation depth of $\frac{1}{4}\lambda$, and the right hand edge ($d_{80}=2.0$) corresponds to a corrugation depth of $\frac{1}{2}\lambda$.

The theory used to generate FIG. 3 is based on an anisotropic wall reactance model, which is equivalent to assuming the waveguide wall has an infinite number of infinitely thin corrugations. For real physical corrugations having a substantial thickness compared to $\lambda$, the ordinates of FIG. 3 no longer correspond to the physical corrugation depth, except for $d_{80}=0$, 1.0, 2.0, etc. An approximate relation between the electrical depth $d_\lambda$and the physical depth is given on page 839 of Dragone, "Reflection, Transmission, and Mode Conversion in a Corrugated Feed," *The Bell System Technical Journal*, Vol. 56, pp. 835–867 (1977). Therefore, $\Delta\beta$ and hence the period P can only be known approximately from theory for a given corrugation, and must be measured if P is to be known precisely. In the discussion that follows, it is thus noted that "d" refers to the idealized (infinitely thin) corrugations, and that $d_{80}=4d/\lambda$. References to the actual physical corrugation depth will be referred to as the "physical depth" or "physical corrugation depth."

FIG. 3 shows that the balanced hybrid condition, with the lowest loss and most symmetric radiation pattern, occurs at $d_{80}=1.0$. Further, the losses remain low in a wide range around $d_{\lambda=1.0}$ if the waveguide is far from cutoff, i.e., if the frequency of the power being transmitted through the waveguide is not close to the cutoff frequency of the waveguide.

Unfortunately, however, near $d_{80}=1.0$, several modes are equally spaced from the $HE_{11}$ mode so that, for example, power coupled to the $HE_{11}$ mode from the $TE_{01}$ mode is coupled back to other modes. This condition is referred to as a degenerate condition. The degeneration difficulty arises after a fraction of the power has been transferred to the $HE_{11}$ mode from the $TE_{01}$ mode. For example, once this initial power transfer has occurred, the coupling provided by the curvature period transfers power back not only to the $TE_{01}$ mode, but also with a larger coupling factor to the $HE_{21}$ mode. A numerical evaluation of this three mode problem shows that with the degeneracy, when the $TE_{01}$ mode power is completely converted, only 20% of it is converted to the $HE_{11}$ mode while 80% goes to the $HE_{21}$ mode. Hence, a corrugation depth of $d_{80}=1.0$ is highly unsatisfactory for an efficient $TE_{01}$ to $HE_{11}$ conversion.

The efficiency of the conversion can be dramatically improved, however, by choosing a shallower or deeper corrugation depth, such as to make $d_{80}\approx 0.2$ or $d_\lambda\approx 1.8$. This is because at these corrugation depths the different modes are better differentiated, as can be seen by their separation in FIG. 3. That is, at these shallower or deeper corrugation depths, operation of the device is outside the degenerate condition. For example, for $d_\lambda<1.0$, $\beta_{21}$ for the $HE_{21}$ mode becomes smaller than $\beta_{01}$ for the $TE_{01}$ mode, approaching that of the $TM_{21}$ mode as $d_\lambda\rightarrow 0$, while $\beta_{21}$ is independent of $d_\lambda$. As $d_\lambda\rightarrow 0$, however, $\beta_{11}$ for the $HE_{11}$ mode approaches $\beta_{01}$ of the $TE_{01}$ mode, which makes the period $P\rightarrow\infty$ (and which, in effect, turns the converter into a $TE_{01}$ to $TM_{11}$ converter). Further, as $d_{80}\rightarrow 0$, $\beta$ for the $EH_{11}$ mode also approaches $\beta$ for the $HE_{11}$ mode, increasing the danger of coupling to the $EH_{11}$ mode. Selecting $d_\lambda\approx 0.2$ thus becomes a good compromise between these constraints. Also, as an additional advantage, the ohmic loss remains low for $d_\lambda\approx 0.2$. (Note that a normalized corrugation depth $d_\lambda=0.2$ corresponds to a corrugation depth d of 1/20th $\lambda$ for the ideal infinitely thin corrugations, or approximately $\lambda/8$ for physical corrugations of real width. The useful range of $d\lambda$ may be from 0.1 to 0.5.)

As indicated above, and as also can be seen from an analysis of FIG. 3, the efficiency of the conversion is also improved by choosing a corrugation depth $d_\lambda>1.0$. While such a selection may make fabrication of the mode converter more difficult, a deeper corrugation depth offers the additional advantage of further reducing the ohmic and other losses. For example, a $d_\lambda$of approximately 1.8 may be utilized (corresponding to a corrugation depth d for infinitely thin corrugations of approximately 9/20 $\lambda$ or $\frac{3}{8}\lambda$ for physical corrugations of real width.) The useful range of $d_\lambda$ is approximately 1.5 to 1.9.

Referring next to FIG. 4, a tunable waveguide mode converter 60 made in accordance with the present invention is described. The tunable converter 60 includes as its primary element a length of circular waveguide 22 having spaced-apart annular corrugations 24 therein. The waveguide 22 is formed into a multiperiod periodic planar curve having a period P, the same as has been previously described in connection with FIGS. 1A–1C. While three periodic curves, P1, P2, and P3 are shown in FIG. 4, it is to be understood that any desired number of curves having a period P could be used. Centering rings 62, selectively positioned along the length of the waveguide 22, center the waveguide relative to its longitudinal axis 64 at desired locations along the longitudinal axis. (The longitudinal axis 64, for purposes of the descriptions presented herein, passes through the center of the input and output sections 32 and 36 of the waveguide.) The placement or relative spacing of these centering rings 62 along the axis 64 thus sets the period P of the curve formed in the waveguide. Offset rings 66 are positioned midway between the centering rings 64 and hold the waveguide 22 away from the axis 64. These offset rings thus define the amplitude A of the deflections thus formed.

Assuming an XYZ coordinate system as shown in FIG. 4, where the Z direction is in the direction of the longitudinal axis 64, and the X direction is perpendicular thereto, it is thus the function of the centering rings 62 to center the waveguide 22 about the longitudinal axis 64 at selected centering locations Z1, Z2, Z3, and Z4, where the distance between adjacent centering rings is equal to the desired period P. Similarly, it is the function of the offset rings 66 to position the waveguide, at locations midway between the centering locations Z1, Z2, Z3, and Z4, a distance in the X direction equal to the desired amplitude A.

FIG. 5A presents an exploded isometric view of one of the centering rings 62 and one of the offset rings 66. The centering ring 62 is essentially a solid cylinder having a channel 65 passing through an upper portion thereof, this channel being centered in the X and Y directions on the axis 64. The diameter of the channel 65 is, at its narrowest point, just large enough to fit snugly over the corrugated waveguide 22. A keyway, slot or channel 68 is placed in the body of the ring 62 below the channel 64. This keyway or slot is sized to fit snugly over a holding rail or bar 70, which bar 70 extends in the Z direction of the XYZ coordinate system shown. Once positioned over the bar, the ring 62 may be moved in the Z direction to any desired position along the bar. A set screw 74, or equivalent locking mechanism, is threadably received in the ring 62 and is used to firmly lock the centering ring at its desired location on the bar 70. In turn, the holding bar 70 is anchored to a suitable support 72 using any suitable fixture apparatus.

FIG. 5B illustrates an alternative approach for anchoring the centering ring or offset ring to the holding bar 70. In accordance with this approach, a circular clamp 75, or equivalent device, wraps around the circumference of the ring 62 or 66 and the holding bar 70. As the clamp is tightened, the ring is firmly held in position against the bar 70.

Returning to FIG. 5A, the offset ring 66 is similar to the centering ring 62 except that it has a channel 74 therethrough that is offset in the X direction relative to the center of the offset ring 66. Such channel 74 is centered, however, in the Y direction relative to the axis 64. The channel 74 has a diameter at its narrowest point the same as the smallest diameter of the channel 65 in the centering ring 62. A keyway, slot or channel 76 placed in the body of the ring 66 allows the ring to be positioned along or against the bar or rail at a desired location. However, unlike the keyway 68 of the centering ring 62, the keyway 76 is wider than the width of the rail 70, thereby allowing the X position of the ring 66 to be adjusted, as required, relative to the bar 70. One or more shims 78 are placed selectively between the bar 70 and the keyway 76 in order to make this adjustment. If needed, a set screw (not shown in FIG. 5A) or equivalent, may be used to lock the Z-position of the offset ring 66 relative to the bar 70 once a desired position has been obtained. Alternatively, a ring clamp may be used as shown in FIG. 5B.

Other adjustment methods that serve the same function as the wide slot and shims in the base of the offset ring 66 may also be used. Any adjustment mechanism that allows movement of center of the channel 74 in a plane passing through the axis 64 may be used.

FIGS. 6A and 6B show end and sectional views, respectively, of the centering ring 62. Similarly, FIGS. 7A and 7B show end and sectional views, respectively, of the offset ring 66. The channels 65 and 74 through both rings have a diameter that varies from a first value D1 near the center of the channel to a second value D2 at the ends of the channel. The convex walls of this type of holding channel provide a suitable interface with the outside walls of the corrugated waveguide 22 that pass through the channel Typically, for a waveguide having a 1.094 inch diameter, designed for operation at 60 Ghz ($\lambda$ =5 mm) the difference between the diameters D1 and D2 is on the order of 0.020 inches.

Figure 8:
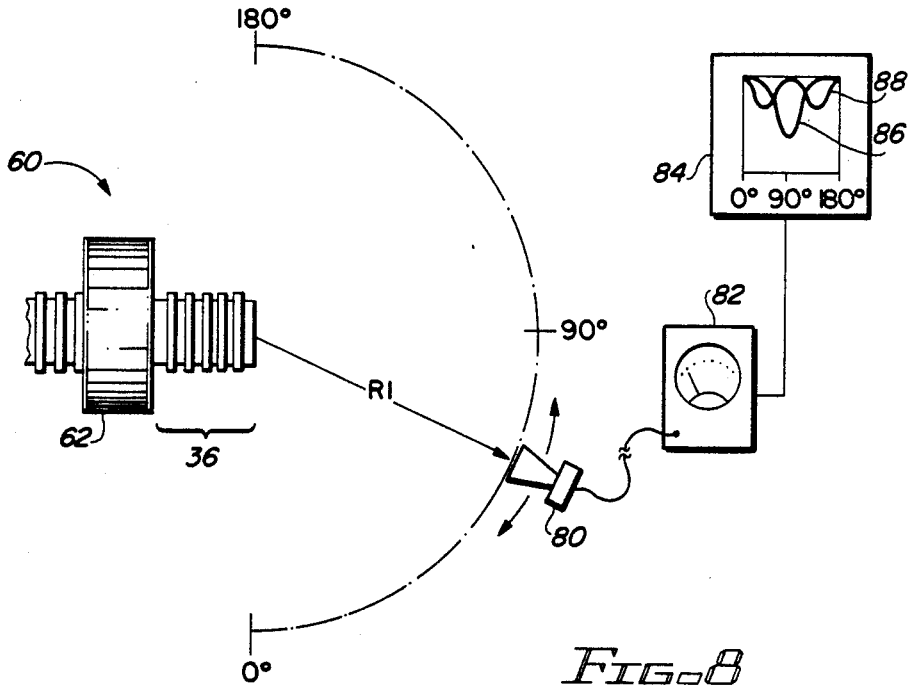
FIG. 8 depicts the manner of measuring the antenna pattern of the mode converter.

Using a waveguide as shown in FIG. 4, it is possible to adjust the period P and amplitude A in order to optimize conversion to the desired $HE_{11}$ output mode. This is done by setting the amplitude A to an initial value and by setting the period P to satisfy initially the relationship $|\beta_0-\beta_1|\approx 2\pi/P$, where $\beta_0$ is the axial wavenumber of the input mode and $\beta_1$ is the estimated axial wavenumber of the desired output mode. Electromagnetic waves of a desired wavelength $\lambda$ are then applied to the first end 32 of the waveguide in a desired mode, such as the $TE_{01}$ mode. The power radiating from the output end 36 in the $HE_{11}$ mode of the converter 60 is then measured as shown in FIG. 8. A polarized receiving horn 80 is positioned a distance R1 from the end of the converter 60. A 180° scan is made in a plane that is perpendicular to the plane of the curve, with the polarized horn 80 being oriented to respond to radiation perpendicular to the plane of the curve. This polarization orientation provides a response to the $HE_{11}$ field while rejecting the $TE_{01}$ field. The output of the horn 80 is attached to a suitable measuring device 82, and the magnitude of the detected $HE_{11}$ radiation is recorded as a function of the scan angle. Preferably, an x-y plotter 84, or equivalent, is connected to the receiving device 82, and synchronized with the scan position of the horn 80, so as to create a plot of the antenna pattern as a function of the scan angle. This measurement when plotted produces a single humped trace 86 indicating the magnitude of the radiated energy in the $HE_{11}$ mode as a function of scan angle. The period P of the mode converter 60 is then adjusted, as required, by repositioning the centering rings 62 along the rail 70 to change the period P to maximize conversion to the $HE_{11}$ mode, i.e., until a maximum peak in the single humped trace 86 is observed.

After the period has been set as described above, a similar scan measurement is made under the same conditions except that the polarizing receiving horn 80 is oriented to respond to radiation in the plane of the waveguide curve, thereby detecting the $TE_{01}$ field while rejecting the $HE_{11}$ field. This measurement is also recorded and plotted, producing a double humped trace 88 on the plotter 84. The amplitude A of the deflections of the mode converter 60 is then adjusted, as required, using the shims 78, in order to minimize power remaining in the $TE_{01}$ mode, i.e., until minimum peaks in the double humped trace 88 are observed. As the power in the $TE_{01}$ mode is minimized, the power converted to the $HE_{11}$ mode increases. The increase in the radiated power in the $HE_{11}$ mode can be verified, as desired, by changing the orientation of the polarized horn 80 and repeating the $HE_{11}$ mode measurements.

EXAMPLE

A tunable mode converter was constructed for use at 60 GHz with a bore diameter of 0.680 inches. The corrugation depth was chosen on the basis of the transverse wave number $K_\perp$. The Transverse wave number $K_\perp$ is often used because the parameter $K_\perp a$, where a is the radius of the waveguide, is a pure number that provides a measure of how far the particular mode is from cutoff. The transverse wave number is determined from the relationship $(2\pi/\lambda)^2=\beta^2+K_\perp^2$. The corrugation depth was chosen based on model measurements so that $K_\perp a$ was approximately equal to 2.76 for the $HE_{11}$ mode, 4.28 for the $HE_{21}$ mode, and 3.72 for the $TE_{01}$ mode.

The corrugation depth thus chosen was 0.025 inches. In addition to the corrugated waveguide of uniform corrugation depth, the converter had a taper of corrugation depths from smooth to the converter's corrugation depth (0.025 inches) at the input end, and a taper of corrugation depths from 0.025 to 0.050 inches at the output end.

Figure 9:
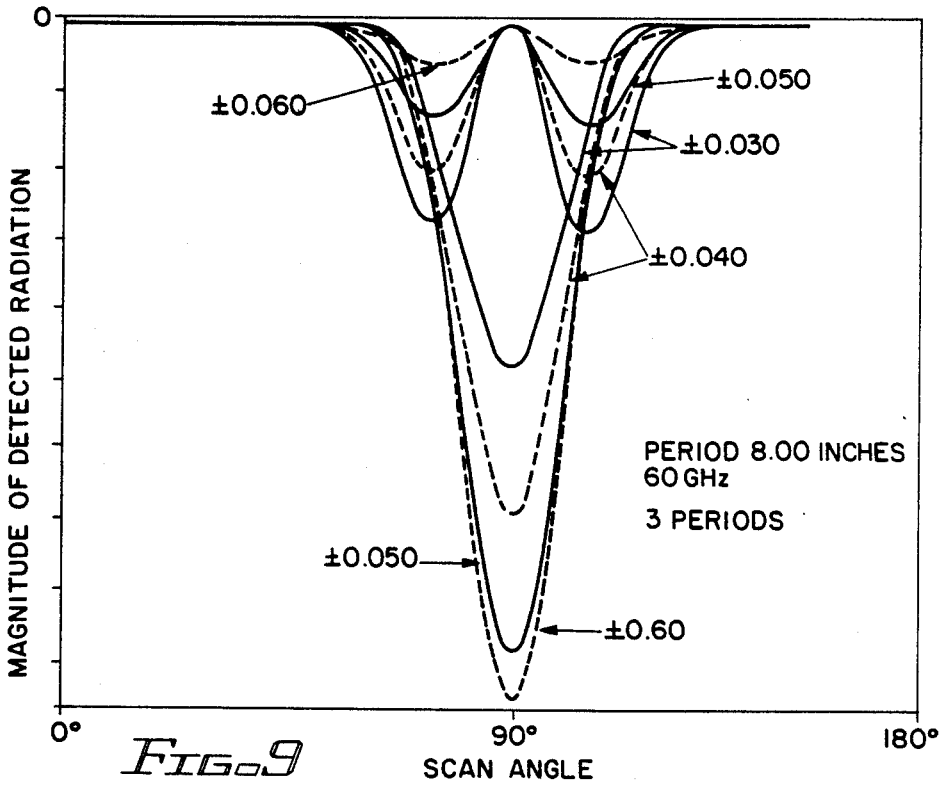
FIG. 9 is a graph that illustrates the antenna pattern obtained using a particular embodiment of the mode converter of the present invention for various amplitudes of deflection.

The corrugated guide section of uniform depth was placed in a holder with centering rings and offset rings equivalent to those shown in FIG. 4. The deflection amplitude was initially fixed at a small value (±0.020 inches), and the period was initially set at 7.14 inches (to satisfy the relationship $|\beta_0-\beta_1|\approx 2\pi/P$). Approximately ¼ of the input power (60 GHz power) transmitted in the $TE_{01}$ mode was initially converted and measured to be in the $HE_{11}$ mode at the output end of the converter. The deflection period was then adjusted to maximize conversion to the $HE_{11}$ mode, as determined by making low power antenna pattern measurements as described above in connection with FIG. 8. The maximum conversion occurred with a period of 8.0 inches. The deflection amplitude was then increased, with measurements being made of both the $HE_{11}$ power (single hump trace) and the $TE_{01}$ power (double humped trace) for each deflection to the limit of the deflection range. FIG. 9 illustrates the results of these measurements for several deflection values. At a deflection of ±0.60 inches, which was the maximum deflection available with the offset rings that were initially used, approximately 90% of the power was converted to the $HE_{11}$ mode. Subsequent adjustments in the adjustment range of the offset rings provided a mode conversion with more than 98% of the power being converted to the $HE_{11}$ mode.

As thus described, it is seen that the present invention provides a wide bandwidth mode converter and method of mode conversion for use with millimeter-wave signals that directly converts a low loss mode, such as the $TE_{01}$ mode or the $TM_{01}$ mode, to the $HE_{11}$ mode. Advantageously, this mode conversion is accomplished while avoiding high loss modes, such as the $TE_{11}$ mode or the $TM_{11}$ mode. The mode conversion is accomplished efficiently using a periodically curved corrugated waveguide wherein the corrugation depth is controlled in order to minimize conversion of power to competing modes. Furthermore, the converter is tuned or adjusted for maximum conversion efficiency, thereby reducing the need for extremely close machining tolerances.

While the invention described herein has been described with reference to a particular embodiment and applications thereof, numerous variations and modifications could be made thereto by those skilled in the art without departing from the spirit and scope of the invention.

What is claimed is:

1. Waveguide mode converting apparatus for converting a first mode of transmission of electromagnetic power at a given free space wavelength to a second mode of transmission at the same wavelength, said apparatus including a length of circular corrugated waveguide of predetermined inner diameter and annular corrugations formed in a multiperiod periodic planar curve with a period substantially equal to $2\pi$ divided by the difference in axial wavenumbers of the respective first and second modes of transmission in said waveguide.

2. Apparatus according to claim 1 wherein the physical depth of said corrugations substantially minimizes the coupling of power to modes of transmission other than said second mode of transmission.

3. Apparatus according to claim 2 wherein said physical depth of said corrugations is between 1/30 and 14/30 of said wavelength, exclusive of physical depths near ¼ said wavelength.

4. Apparatus according to claim 3 wherein said physical depth of said corrugation is about ⅜ said wavelength. length.

5. Apparatus according to claim 3 wherein said physical depth of said corrugation is about ⅝ said wavelength.

6. Apparatus according to claim 1 wherein said annular corrugations are evenly spaced.

7. Apparatus according to claim 6 wherein the spacing of said corrugations is less than half said wavelength.

8. Apparatus according to any one of claims 1–7 further including an input section of circular corrugated waveguide of said predetermined inner diameter and having annular corrugations increasing in depth in the direction of transmission from zero at the input end of said input section to the depth of corrugations in said length of waveguide, and an output section of circular corrugated waveguide of said predetermined inner diameter and having annular corrugations gradually changing in depth in the direction of transmission to substantially ¼ said wavelength at the output end of said output section from the depth of corrugations in said length of waveguide, said input section preceding and said output section following said length of waveguide in the direction of transmission.

9. Apparatus according to any one of claims 1–7 further including means for adjusting the period of said curve and its amplitude.

10. Apparatus according to claim 1 wherein said curve is cyclic with symmetric cycles.

11. Apparatus according to claim 1 wherein said curve is substantially sinusoidal.

12. A tunable waveguide mode converter comprising:

a length of circular corrugated waveguide formed into a multiperiod periodic planar curve, the periods of said multiperiod curve having a period P measured along a longitudinal axis of the waveguide, and said periodic planar curve having an amplitude A measured transverse to the longitudinal axis;

first adjustment means for selectively adjusting said period P; and means for coupling electromagnetic power having a free space wavelength λ in a first transmission mode to a first end of said length of circular waveguide;

said period P being adjusted with said first adjustment means to couple power of said first transmission mode to a second transmission mode and decouple power of said first transmission mode to modes other than said second transmission mode.

13. The converter as set forth in claim 12 further including second adjustment means for selectively adjusting said amplitude A, said amplitude A being adjusted with said second adjustment means to maximize the power converted to said second transmission mode from said first transmission mode.

14. The converter as set forth in claim 13 wherein said first and second adjustment means comprise:

a support bar; and means for holding selected segments of said corrugated waveguide in respective spaced relationship relative to said support bar;

at least one of said holding means including means for adjusting the spaced relationship between its respective corrugated waveguide segment and said support bar.

15. The converter as set forth in claim 14 wherein said plurality of holding means each comprise a ring having a base, said ring having an inside diameter that snugly fits around said corrugated waveguide, said base including means for securing said ring to said support bar.

16. The converter as set forth in claim 15 wherein said inside diameter of said ring varies from a first maximum value at its ends to a second minimum value in between its ends.

17. The converter as set forth in claim 12 wherein said corrugations of said corrugated waveguide are annular corrugations having a specified physical corrugation depth, said specified physical depth being a prescribed percentage of the wavelength $\lambda$ of the electromagnetic power applied to said waveguide.

18. The converter as set forth in claim 17 wherein said prescribed corrugation depth is less than $\frac{1}{4}\lambda$ and greater than about $1/30\ \lambda$.

19. The converter as set forth in claim 18 wherein, said prescribed corrugation depth is greater than $\frac{1}{4}\lambda$ and less than about $14/30\ \lambda$.

20. The converter as set forth in claim 17 wherein said first transmission mode of said electromagnetic power applied to the first end of said waveguide comprises a $TE_{01}$ or $TM_{02}$ mode, and wherein said second transmission mode comprises an $HE_{11}$ mode.

21. A method for converting electromagnetic power at a given free space wavelength from a $TE_{01}$ or $TM_{02}$ input mode, to an $HE_{11}$ output mode, said method comprising applying said power in said input mode to the input end of a length of circular corrugated waveguide of given inner diameter and annular corrugations formed in a multiperiod periodic planar curve, adjusting the period of said curve to maximize power radiating from the output end of said length of waveguide in said $HE_{11}$ output mode, and adjusting the amplitude of said curve to minimize the power radiating from the output end of said length of waveguide in said input mode, thereby achieving maximum conversion to the $HE_{11}$ mode.

* * * * *